United States Patent [19]

Eylon et al.

[11] Patent Number: 4,822,432

[45] Date of Patent: Apr. 18, 1989

[54] METHOD TO PRODUCE TITANIUM METAL MATRIX COPOSITES WITH IMPROVED FRACTURE AND CREEP RESISTANCE

[75] Inventors: Daniel Eylon, Dayton; Francis H. Froes, Xenia, both of Ohio

[73] Assignee: The United States of America as represented by the Secretary of the Air Force, Washington, D.C.

[21] Appl. No.: 150,677

[22] Filed: Feb. 1, 1988

[51] Int. Cl.[4] ..... C22C 1/09; C22F 1/02; C22F 1/18

[52] U.S. Cl. ..... 148/127; 148/133

[58] Field of Search ..... 148/11.5 F, 11.5 Q, 148/20.3, 133, 13.1, 127; 428/608, 614; 228/190

[56] References Cited

U.S. PATENT DOCUMENTS

| | | | |
|---|---|---|---|
| 3,991,928 | 11/1976 | Friedrich et al. | 228/190 |
| 4,415,375 | 11/1983 | Lederich et al. | 148/11.5 F |
| 4,482,398 | 11/1984 | Eylon et al. | 148/11.5 F |
| 4,499,156 | 2/1988 | Smith et al. | 428/614 |
| 4,505,764 | 3/1985 | Smickley et al. | 148/133 |
| 4,536,234 | 8/1985 | Eylon et al. | 148/133 |
| 4,612,066 | 9/1986 | Levin et al. | 148/20.3 |
| 4,680,063 | 7/1987 | Vogt et al. | 148/11.5 F |
| 4,714,587 | 12/1987 | Eylon et al. | 148/11.5 F |
| 4,733,816 | 3/1988 | Eylon et al. | 228/190 |
| 4,746,374 | 5/1988 | Froes et al. | 148/11.5 Q |

OTHER PUBLICATIONS

F. H. Froes et al., "Production of Metal Matrix Composites from Rapidly Solidified Titanium Alloy Foils", *Titanium,* The Metallurgical Society-1986 TMS-AIME, pp. 311-323.

*Primary Examiner*—John J. Zimmerman

*Attorney, Agent, or Firm*—Charles E. Bricker; Donald J. Singer

[57] ABSTRACT

A method for improving the microstructure of consolidated titanium alloy metal matrix composites which comprises the steps of (a) heating the composite to a temperature in the range of 800° to 2000° F., the temperature being below the temperature at which interfacial reactions occur between the metal matrix and the fiber, and diffusing hydrogen into the composite to achieve a hydrogen level of about 0.50 to 1.50 weight percent;

(b) altering the temperature of the composite to a transformation temperature at or near the temperature of transformation of (HCP) alpha in the hydrogenated composite to (BCC) beta;

(c) cooling the composite to room temperature;

(d) heating the thus-cooled composite to a temperature below the transformation temperature, and diffusing hydrogen out from the composite; and (e) cooling the composite to room temperature.

4 Claims, No Drawings

METHOD TO PRODUCE TITANIUM METAL MATRIX COPOSITES WITH IMPROVED FRACTURE AND CREEP RESISTANCE

RIGHTS OF THE GOVERNMENT

The invention described herein may be manufactured and used by or for the Government of the United States for all governmental purposes without the payment of any royalty.

BACKGROUND OF THE INVENTION

This invention relates to titanium alloy/fiber composite materials. In particular, this invention relates to a method for improving the microstructure of such composite materials.

In recent years, material requirements for advanced aerospace applications have increased dramatically as performance demands have escalated. As a result, mechanical properties of monolithic metallic materials such as titanium alloys often have been insufficient to meet these demands. Attempts have been made to enhance the performance of titanium by reinforcement with high strength/high stiffness filaments or fibers.

Titanium matrix composites have for quite some time exhibited enhanced stiffness properties which closely approach rule-of-mixtures (ROM) values. However, with few exceptions, both tensile and fatigue strengths are well below ROM levels and are generally very inconsistent.

These titanium composites are typically fabricated by superplastic forming/diffusion bonding of a sandwich consisting of alternating layers of metal and fibers. At least four high strength/high stiffness filaments or fibers for reinforcing titanium alloys are commercially available: silicon carbide, silicon carbide-coated boron, boron carbide-coated boron and silicon-coated silicon carbide. Under superplastic conditions, which involve the simultaneous application of pressure and elevated temperature, the titanium matrix material can be made to flow without fracture occurring, thus providing intimate contact between layers of the matrix material and the fibers. The thus-contacting layers of matrix material bond together by a phenomenon known as diffusion bonding. Unfortunately, at the time of high temperature bonding a reaction can occur at the fiber-matrix interfaces, giving rise to what is called a reaction zone leading to lower mechanical properties. The compounds formed in the reaction zone may include reaction products like TiSi, $Ti_5Si$, TiC, TiB and $TiB_2$. The thickness of the reaction zone increases with increasing time and with increasing temperature of bonding.

Titanium matrix composites have not reached their full potential, at least in part, because of problems associated with instabilities of the fiber-matrix interface. The reaction zone surrounding a filament introduces sites for easy crack initiation and propagation within the composite, which can operate in addition to existing sites introduced by the original distribution of defects in the filaments. It is well established that mechanical properties of metal matrix composites are influenced by the reaction zone, and that, in general, these properties are graded in proportion to the thickness of the reaction zone.

Several methods have been proposed for reducing, if not eliminating the interfacial reactions. Friedrich et al, U.S. Pat. No. 3,991,928, disclose that interfacial reactions between reinforcing silicon coated boron fibers and commercially available rolled beta titanium alloy foil can be substantially eliminated by consolidating a stack of fiber-reinforced foils with an applied pressure in excess of 22 ksi. and a temperature of about 1250° to 1275° F. Smith et al, U.S. Pat. No. 4,499,156, disclose that interfacial reactions between a variety of reinforcing fibers and titanium alloy foils can be substantially eliminated by extensively cold working the alloy to obtain a sheetstock having a grain size less than 10 microns, then consolidating a stack of these cold-worked foils with interspersed fibers with an applied pressure of 10 to 100 MPa and a temperature about 10° to 100° C. below the beta-transus temperature of the alloy. More recently, Eylon et al, in U.S. patent applications Ser. No. 935,362 and Ser. No. 935,363, both filed Nov. 26, 1986, and Ser. No. 936,679, filed Dec. 1, 1986, disclose methods for preparing titanium alloy composite structures which comprise the use of rapidly solidified titanium alloy foils and consolidation with an applied pressure of 1.5 to 15 Ksi and a temperature below the beta-transus temperature of the alloy.

The matrix microstructure of a consolidated composite is a very fine equiaxed alpha structure, the result of the large amount of alpha+beta deformation during compaction, i.e. superplastic forming/diffusion bonding, as well as the compaction thermal cycle which is carried out in the alpha+beta phase field. While the fiber-reinforced matrix has better tensile strength than the unreinforced metal, the very fine equiaxed titanium alpha microstructure of a consolidated composite has low fracture resistance and low creep strength. The fracture resistance and creep strength of non-fiber-reinforced titanium alloys can be improved by heat treating the alloy at a temperature above its beta-transus temperature, which results in a lenticular alpha plate morphology with excellent fracture and creep resistance. The fracture resistance and creep strength of a consolidated composite can be improved after compaction by similar heat treatment which products a matrix with lenticular alpha plate microstructure. Such heat treatment cannot be done prior to fabrication of the composite because the matrix material will not flow unless it has the equiaxed alpha morphology. On the other hand, it is undesirable to heat treat a composite after compaction, because of the development of interfacial reactions between the reinforcing fiber and the titanium alloy matrix at higher temperatures.

Accordingly, it is an object of the present invention to provide a method for improving the microstructure of titanium alloy metal matrix composites.

Other objects and advantages of the present invention will be apparent to those skilled in the art.

SUMMARY OF THE INVENTION

In accordance with the present invention, there is provided a method for improving the microstructure of consolidated titanium alloy metal matrix composites which comprises the steps of (a) heating the composite to a temperature in the range of 800° to 2000° F., the temperature being below the temperature at which interfacial reactions occur between the metal matrix and the fiber, and diffusing hydrogen into the composite to achieve a hydrogen level of about 0.50 to 1.50 weight percent;

(b) altering the temperature of the composite to a transformation temperature at or near the temperature of transformation of (HCP) alpha in the hydrogenated composite to (BCC) beta;

(c) cooling the composite to room temperature;

(d) heating the thus-cooled composite to a temperature below the transformation temperature, and diffusing hydrogen out from the composite; and (e) cooling the composite to room temperature.

DESCRIPTION OF THE INVENTION

The titanium alloys employed according to the invention are alpha+beta-titanium alloys. It will be understood that the term "alpha+beta-titanium" means an alloy of titanium which is characterized by the presence of significant amounts of alpha phase and some beta phase. Thus, the use of the so-called "alpha-beta" alloys, such as Ti-6Al-4V, as well as the so-called "beta" alloys, such as Ti-15V-3Cr-3Al-3Sn or Ti-10V-2Fe-3Al, constitute part of this invention. Other suitable alloys include, for example, Ti--6Al-6V-2Sn, Ti-8Mn, Ti-7Al-4Mo, Ti-4.5Al-5Mo-1.5Cr, Ti-6Al-2Sn-4Zr-6Mo, Ti-5Al-2Sn-2Zr-4Mo-4Cr, Ti-6Al-2Sn-2Zr-2Mo-2Cr, Ti-5.5Al-3.5Sn-3Zr-0.3Mo-1Nb-0.3Si, Ti-5.5Al-4Sn-4Zr-0.3Mo-1Nb-0.5Si-0.06C, Ti-30Mo, Ti-13V-11Cr-3Al, Ti-3Al-8V-6Cr-4Mo-4Zr, Ti-15V, Ti-11.5Mo-6Zr-4.5Sn, Ti-10Mo, and Ti-6.3Cr.

The alpha+beta titanium alloys are generally supplied by the manufacturer in the form of sheet or foil having a thickness of from 5 to 10 mils.

The high strength/high stiffness fibers or filaments employed according to the present invention are produced by vapor deposition of boron or silicon carbide to a desired thickness onto a suitable substrate, such as carbon monofilament or very fine tungsten wire. This reinforcing filament may be further coated with boron carbide, silicon carbide or silicon. As indicated previously, at least four high strength/high stiffness fibers or filaments are commercially available: silicon carbide, silicon carbide-coated boron. Boron carbide-coated boron, and silicon-coated silicon carbide.

A composite preform may be fabricated in any manner known in the art. For example, plies of alloy sheet or foil and filamentary material may be stacked by hand in alternating fashion. The quantity of filamentary material included in the preform should be sufficient to provide about 25 to 45, preferably about 35 volume percent of fibers.

Consolidation of the filament/sheetstock preform is accomplished by application of heat and pressure over a period of time during which the alloy matrix material is superplastically formed around the filaments to completely embed the filaments. The conditions for consolidation are well known in the art and do not form a part of the present invention.

Following consolidation, the composite is hydrogenated. Titanium and its alloys have an affinity for hydrogen, being able to dissolve up to about 3 weight percent (60 atomic percent) of hydrogen at 590° C. (1060° F.). While it may be possible to hydrogenate the composite to the maximum level of hydrogen, it is presently preferred to hydrogenate the composite to a level of about 0.5 to 1.5 weight percent hydrogen to prevent cracking of the hydrogenated composite during the subsequent cooling step.

Hydrogenation is carried out in a suitable, closed apparatus at an elevated temperature by admitting sufficient hydrogen to attain the desired concentration of hydrogen in the alloy. The hydrogenation step is carried out at a temperature of about 800° to 2000° F., generally about 200° to 400° F. below the normal beta transus temperature of the alloy. It is important that the temperature of hydrogenation be lower than the temperature at which interfacial reactions between the matrix and the fibrous material normally occur.

Heating of the composite to the desired temperature is conducted under an inert atmosphere. When the hydrogenation temperature is reached, hydrogen is added to the atmosphere within the apparatus. The partial pressure of the hydrogen added to the atmosphere and the time required for hydrogenation are dependent upon such factors as the size and cross-section of the composite article, the temperature of hydrogenation and the desired concentration of hydrogen in the article. A typical composition for the gas environment would be a mixture consisting of 96 weight percent argon and 4 weight percent hydrogen, i.e., hydrogen makes up about 43 volume percent of the gas mixture. The composition of the gas is not critical, but it is preferred that the quantity of hydrogen be less than about 5 weight percent to avoid creation of a flammable mixture.

Following the hydrogenation step, the temperature of the composite article is altered to a transformation temperature above, at or slightly below the temperature of transformation of (HCP) alpha to (BCC) beta. In the non-hydrogenated alloy, this temperature is referred to as the beta-transus temperature. For convenience, the temperature of transformation of (HCP) alpha to (BCC) beta in the hydrogenated composite will be referred to as the hydrogenated-beta-transus temperature. The hydrogenated-beta-transus temperature, in general, is about 200° to 500° F. below the normal beta-transus temperature of the alloy. Thus, in the case of Ti-6Al-4V, which has a beta-transus temperature of about 1800° F., has, following hydrogenation to about 0.5 to 1.5 weight percent hydrogen, a hydrogenated-beta-transus temperature of about 1400° to 1600° F.

Following the hydrogenation step, the composite is cooled from the hydrogenated-beta-transus temperature at a controlled rate to about room temperature. The rate is controlled to be about 10° to 70° F. per minute. This controlled rate cooling step is critical to providing the desired microstructure. If the rate is too high, cracking and distortion of the article may result. A slower cooling rate may lead to the formation of a coarse lenticular structure which will not provide satisfactory fracture and creep resistance properties.

While we do not wish to be held to any particular theory of operation, it is believed that as the hydrogenated composite article cools, metal hydrides, particularly titanium hydrides, form within the matrix of alpha and beta titanium. Because the metal hydrides have a different volume than the titanium matrix grains, there is initiated localized deformation on a microscopic scale. As a result, when the material is reheated for removal of the hydrogen, the microdeformed regions cause localized recrystallization which results in a low aspect ratio grain structure or breakup of the plate structure.

It is within the scope of this invention to carry out the hydrogenation step at the hydrogenation-beta-transus temperature. It is, however, preferred to introduce hydrogen into the composite at as low a temperature as possible commensurate with the quantity of hydrogen desired in the composite, then increase the temperature of the thus-hydrogenated composite to the hydrogenated-beta-transus temperature, then cool the hydrogenated composite to room temperature, in order to minimize the time at higher temperature, thereby decreasing the change for interfacial reaction.

Dehydrogenation of the hydrogenated composite is accomplished by heating the composite under vacuum to a temperature of about 1200° to 1400° F. The time for the hydrogen removal will depend on the size and cross-section of the composite article, the volume of hydrogen to be removed, the temperature of dehydrogenation and the level of vacuum in the apparatus used for dehydrogenation. The term "vacuum" is intended to mean a vacuum of about $10^{-2}$ mm Hg or less, preferably about $10^{-4}$ mm Hg or less. The time for dehydrogenation must be sufficient to reduce the hydrogen content in the article to less than the maximum allowable level. For the alloy Ti-6Al-4V, the final hydrogen level must be below about 120 ppm to avoid degradation of mechanical properties. Generally, about 15 to 60 minutes at dehydrogenation temperature and under vacuum, is sufficient to ensure substantially complete evolution of hydrogen from the article. Heating is then discontinued and the article is allowed to cool, at the previously described controlled rate, to room temperature.

The method of this invention is generally applicable to the manufacture of aircraft components, as well as non-aerospace components. This method is particularly applicable to the production of creep and fracture resistant titanium alloy articles, such as, for example, aircraft engine mount supports, load carrying wing sections and nacelles,and the like. By temporarily introducing hydrogen into the titanium metal matrix composite, it is possible to produce a beta quenched microstructure at a solution treatment temperature considerably lower than in a non-hydrogenated material. The lower treatment temperature, together with a shorter time at the treatment temperature, contributes toward limiting the reaction zone size. The beta quenched microstructure with a lenticular alpha plate morphology of titanium metal matrix composites treated in accordance with the invention is very good for creep and fracture resistance.

Various modifications may be made to the present invention without departing from the spirit and scope of the invention.

We claim:

1. A method for improving the microstructure of a consolidated titanium alloy metal matrix composite consisting of a plurality of alternating layers of titanium alloy and reinforcing fibers which comprises the steps of:

(a) heating the composite to a temperature in the range of 800° to 2000° F., said temperature being below the temperature at which interfacial reactions occur between the metal matrix and the fiber, and diffusing hydrogen into the composite to achieve a hydrogen level of about 0.50 to 1.50 weight percent;

(b) altering the temperature of said composite to a transformation temperature approximately equal to the temperature of transformation of (HCP) alpha in the hydrogenated composite to (BCC) beta;

(c) cooling the composite to room temperature;

(d) heating the thus-cooled composite to a temperature below said transformation temperature, and diffusing hydrogen out from said composite; and (e) cooling said composite to room temperature.

2. The method of claim 1 wherein said hydrogenation step (a) is carried out at a temperature about 200° to 500° F. below the normal beta transus temperature of said alloy.

3. The method of claim 1 wherein said cooling step (c) is carried out at a controlled rate of about 10° to 70° F. per minute.

4. The method of claim 1 wherein said dehydrogenation step (d) is accomplished by heating said composite under vacuum to a temperature of about 1200° to 1400° F. for about 15 to 60 minutes.

* * * * *

UNITED STATES PATENT AND TRADEMARK OFFICE

CERTIFICATE OF CORRECTION

PATENT NO. : 4,822,432

DATED : April 18, 1989

INVENTOR(S) : Daniel Eylon et al

It is certified that error appears in the above-identified patent and that said Letters Patent is hereby corrected as shown below:

On the title page, in the title,
line 2, correct the spelling of "COMPOSITES".

Col 1, line 2, correct the spelling of "COMPOSITES".

Col 1, line 63, change "graded" to ---degraded---.

Col 3, line 38, after "boron", first occurrence, change ". Boron" to ---, boron---.

Col 5, line 3, change the word "change" to ---chance---.

Signed and Sealed this

Twentieth Day of February, 1990

*Attest:*

JEFFREY M. SAMUELS

*Attesting Officer* *Acting Commissioner of Patents and Trademarks*